US011313226B2

(12) United States Patent
Zhou et al.

(10) Patent No.: US 11,313,226 B2
(45) Date of Patent: Apr. 26, 2022

(54) INTERNALLY INJECTED REPLACEMENT SUPPORT ROOM-TYPE COAL PILLAR RECOVERY METHOD

(71) Applicant: CHINA UNIVERSITY OF MINING AND TECHNOLOGY, Jiangsu (CN)

(72) Inventors: Nan Zhou, Jiangsu (CN); Jiaqi Wang, Jiangsu (CN); Jixiong Zhang, Jiangsu (CN); Kai Sun, Jiangsu (CN); Meng Li, Jiangsu (CN)

(73) Assignee: CHINA UNIVERSITY OF MINING AND TECHNOLOGY, Jiangsu (CN)

( * ) Notice: Subject to any disclaimer, the term of this patent is extended or adjusted under 35 U.S.C. 154(b) by 0 days.

(21) Appl. No.: 16/603,832

(22) PCT Filed: Feb. 22, 2019

(86) PCT No.: PCT/CN2019/075863
§ 371 (c)(1),
(2) Date: Jul. 16, 2020

(87) PCT Pub. No.: WO2020/048095
PCT Pub. Date: Mar. 12, 2020

(65) Prior Publication Data

US 2020/0378255 A1 Dec. 3, 2020

(30) Foreign Application Priority Data

Sep. 4, 2018 (CN) ..... 201811027251.3

(51) Int. Cl.
*E21F 15/00* (2006.01)
*E21C 41/18* (2006.01)
(Continued)

(52) U.S. Cl.
CPC ..... *E21C 41/18* (2013.01); *E21D 15/005* (2013.01); *E21D 15/02* (2013.01); *E21F 15/00* (2013.01); *G06Q 50/02* (2013.01); *E21F 15/005* (2013.01)

(58) Field of Classification Search
CPC ..... E21D 15/005; E21F 15/005; E21C 41/18
(Continued)

(56) References Cited

U.S. PATENT DOCUMENTS 4,198,097 A 4/1980 Fondriest
2020/0318480 A1* 10/2020 Zhou ..... E21C 41/18

FOREIGN PATENT DOCUMENTS

CN 101725352 6/2010
CN 103527196 1/2014
(Continued)

OTHER PUBLICATIONS

"International Search Report (Form PCT/ISA/210) of PCT/CN2019/075863," dated Apr. 30, 2019, pp. 1-5.

*Primary Examiner* — Sunil Singh
(74) *Attorney, Agent, or Firm* — JCIPRNET

(57) ABSTRACT

An internally injected replacement support room-type coal pillar recovery method is provided. During the recovery, the room-type coal pillars with an aspect ratio greater than 0.6 are divided into two parts: reserved coal pillars and pre-mined coal pillars. After the mining of the pre-mined coal pillars, a cemented filling material is injected into a goaf surrounded by the reserved coal pillars, and is stabilized to replace the coal pillars for support, and the reserved coal pillars are recovered. A mechanical model of the reserved coal pillars in a support overburden stage is established based on the Winkler beam theory, to obtain displacement and stress conditions of a roof of the reserved coal pillar in a support stage. A theoretical reserve-width of the reserved coal pillars is obtained according to a first strength theory of
(Continued)

the roof and a criterion of ultimate strength of the reserved coal pillars.

5 Claims, 4 Drawing Sheets

(51) Int. Cl.
*E21D 15/00* (2006.01)
*E21D 15/02* (2006.01)
*G06Q 50/02* (2012.01)

(58) Field of Classification Search
USPC ..... 405/288; 299/11, 12, 19
See application file for complete search history.

(56) References Cited

FOREIGN PATENT DOCUMENTS

| | | |
|---|---|---|
| CN | 105240014 | 1/2016 |
| CN | 107514259 | 12/2017 |
| CN | 109139100 | 1/2019 |

* cited by examiner (a) Schematic diagram for support structure of the reserved coal pillars (b) Simplified mechanical model

INTERNALLY INJECTED REPLACEMENT SUPPORT ROOM-TYPE COAL PILLAR RECOVERY METHOD

CROSS-REFERENCE TO RELATED APPLICATION

This application is a 371 application of International PCT application serial no. PCT/CN2019/075863, filed on Feb. 22, 2019, which claims the priority benefit of Chinese application no. 201811027251.3, filed on Sep. 4, 2018. The entirety of each of the abovementioned patent applications is hereby incorporated by reference herein and made a part of this specification.

BACKGROUND

Technical Field

The present invention belongs to the field of coal pillar recovery, and particularly relates to an internally injected replacement support room-type coal pillar recovery method, particularly suitable for the replacement support recovery of a room-type coal pillar with an aspect ratio greater than 0.6 left after coal mining.

Description of Related Art

Room-type mining methods in China are mostly applied to the northwestward region, mainly concentrated in the mining areas such as Shaanxi, Inner Mongolia and Shanxi with wide resource distribution, simple geological structure and shallow coal seams. Although the room-type coal pillar has the characteristics of low investment, simple management and high production efficiency, the remaining coal pillars after mining will directly affect the mine safety and threaten the surrounding ecological environment. Recovery of room-type mining coal pillars can simultaneously solve problems such as coal resource waste, ecological environment and geological disasters.

At present, domestic room-type coal pillar recovery methods are mainly divided into traditional recovery methods and filling recovery methods. The traditional recovery methods such as splitting and pocket and wing recovery methods are low in recovery rate and mechanization degree, and the filling recovery methods such as casting and filling recovery and comprehensive mechanization filling recovery methods require high filling material costs and equipment input costs.

Therefore, it is a major technical issue in coal mining to study a room-type coal pillar recovery method that can ensure the recovery efficiency, the roof stability, and reasonable investment.

SUMMARY

Object of the invention: in order to solve the problem of safe, efficient and low-cost recovery of remaining coal pillars after the room-type mining, the object of the present invention is to provide an internally injected replacement support room-type coal pillar recovery method with simple operation and high resource recovery rate.

Technical solution: in order to achieve the foregoing object, the present invention adopts the following technical solution:

An internally injected replacement support room-type coal pillar recovery method, including the following steps:

1) dividing a room-type coal pillar into a peripheral reserved coal pillar and an internal pre-mined coal pillar, a reserved coal pillar gap being formed on one side of the reserved coal pillar;

2) stoping the internal pre-mined coal pillar by means of the reserved coal pillar gap;

3) blocking the reserved coal pillar gap after the pre-mined coal pillar is mined, and injecting a cemented filling material into a goaf surrounded by the reserved coal pillar for filling; and 4) replacing the coal pillar for support after the cemented filling material is stabilized, and then recovering the reserved coal pillar.

Further, the room-type coal pillar has an aspect ratio greater than 0.6.

Further, in step 1), the displacement and stress conditions of the roof when the reserved coal pillar is in the support stage are obtained according to a calculation result of a mechanical model of the reserved coal pillar in the support overburden stage; and the theoretical reserve-width of the reserved coal pillar is obtained according to the first strength theory of the roof and the criterion of ultimate strength of the reserved coal pillar, so that the room-type coal pillar is divided into the reserved coal pillar and the pre-mined coal pillar.

Further, the width of the reserved coal pillar is calculated by a process as follows:

a. intercepting a half-plane of the room-type coal pillar for analysis, and setting the overburden stratum acting force on the roof to be a uniform load q, a foundation coefficient of the reserved coal pillar to be k, the spacing of the adjacent room-type coal pillars to be c, the width of the reserved coal pillar to be b, the width of the pre-mined coal pillar to be a, and then the total width of the room-type coal pillars to be 2(a+b), wherein a differential equation of the deflection curve of each section of the roof in the analyzed area is:

$$\begin{cases} EI\dfrac{d^4\omega_1(x)}{dx^4} = q & x \in [0, a] \\ EI\dfrac{d^4\omega_2(x)}{dx^4} = q - k\omega_2(x) & x \in [a, a+b] \\ EI\dfrac{d^4\omega_3(x)}{dx^4} = q & x \in [a+b, a+b+c] \end{cases} \quad \text{(i)}$$

in the formula, EI is the flexural rigidity, in N/m;

x is the distance between any point on the foundation surface and the coordinate origin of the half-plane, in m; and $\omega_1(x)$, $\omega_2(x)$, and $\omega_3(x)$ are the deflections of x at sections [0, a], [a, a+b], [a+b, a+b+c] of the roof, respectively, in m;

b. solving the formula (i), and letting $$\alpha = \sqrt[4]{\frac{k}{4EI}},$$

to obtain an equation of the deflection curve of the roof:

$$\begin{cases} \omega_1(x) = \frac{q}{24EI}x^4 + d_1x^3 + d_2x^2 + d_3x + d_4 \\ \omega_2(x) = \frac{q}{k} + d_5e^{-\alpha x}\cos(\alpha x) + d_6e^{-\alpha x}\sin(\alpha x) + \\ d_7e^{\alpha x}\cos(\alpha x) + d_8e^{\alpha x}\sin(\alpha x) \\ \omega_3(x) = \frac{q}{24EI}x^4 + d_9x^3 + d_{10}x^2 + d_{11}x + d_{12} \end{cases} \quad \text{(ii)}$$

in the formula, $d_1$, $d_2$, $d_3$, $d_4$, . . . and $d_{12}$ are constant coefficients; and obtaining parameters $d_1$-$d_{12}$ according to a model continuity condition and a symmetry boundary condition;

c. solving to obtain an equation of bending moment of the roof:

$$\begin{cases} M_1(x) = -EI\frac{d^2\omega_1}{dx_2} \\ M_2(x) = -EI\frac{d^2\omega_2}{dx_2} \\ M_3(x) = -EI\frac{d^2\omega_3}{dx_2} \end{cases} \quad \text{(iii)}$$

in the formula, $M_1(x)$, $M_2(x)$, and $M_3(x)$ are the bending moments of x at sections [0, a], [a, a+b], and [a+b, a+b+c] of the roof, respectively, in m; wherein the width b of the reserved coal pillar needs to simultaneously satisfy the first strength theory of the roof and the ultimate strength theory of the coal pillar, namely, simultaneously satisfying that the width b of the reserved coal pillar is greater than or equal to the minimum reserve-width $b_1$ under the conditions of the first strength theory of the roof and the minimum reserve-width $b_2$ under the conditions of the ultimate strength theory of the coal pillar, specifically as shown in the following steps d and e:

d. simplifying the roof to a simply supported beam with an overburden uniform load q and a support load with the width $b_1$ at the bottom, wherein it is found through analysis that the maximum bending moment $M_{max}$ on the roof occurs in one side of the beam span that deviates from the bottom support load and is spaced apart from the model origin by $x_m = a+b_1+3EI\cdot d_9/q$, and a value thereof is obtained by $M_3(x_m)$ in the formula (iii), and the maximum tensile stress of the roof is obtained according to the rectangular beam theory:

$$\sigma_{max} = \frac{6M_{max}}{h^2} \quad \text{(iv)}$$

in the formula, h is the roof height, in m;

the following formula shall be satisfied according to the first strength theory of the roof, so that the roof is not broken:

$$\sigma_{max} \leq [\sigma_t] \quad \text{(v)}$$

in the formula, $[\sigma_t]$ is the allowable tensile stress of the roof, in MPa; and since the spacing c between the adjacent room-type coal pillars and the width 2(a+b) of the room-type coal pillar are known, the minimum reserve-width $b_1$ of the reserved coal pillar under the conditions of the first strength theory of the roof is obtained according to the judgment condition of the formula (iv);

e. making the minimum reserve-width $b_2$ of the reserved coal pillar under the conditions of the ultimate strength theory of the coal pillar satisfy its own non-destruction at the same time, and satisfying according to the ultimate strength theory:

$$\sigma F \leq \sigma_P \quad \text{(vi)}$$

in the formula, σ is the force acting on the coal pillar, $\sigma = k\int_a^{a+b} \omega_2(x)dx$, in m;

F is a safety coefficient, which may be 2; and $\sigma_p$ is the ultimate strength of the reserved coal pillar, in MPa;

calculating the minimum reserve-width of the reserved coal pillar under the conditions of the ultimate strength theory of the coal pillar to be $b_2$ according to the formula (vi); and f. finally calculating the minimum reserve-width of the reserved coal pillaro be $b = \max\{b_1, b_2\}$.

Further, in step 2), a continuous miner is used to stope the pre-mined coal pillar, and the mined coal is transported onto a belt conveyor by means of a forklift and transported out of a mining area by means of the belt conveyor.

Further, in step 3), a blocking wall is piled up to block the reserved coal pillar gap, and the cemented filling material is pumped, by a filling pump through a pumping port reserved on the blocking wall, to the goaf of the room-type coal pillar for filling.

Advantageous effects: compared with the prior art, the internally injected replacement support room-type coal pillar recovery method provided by the present invention has the following advantages: the present invention is particularly suitable for safe, efficient, and low-cost recovery of the remaining coal pillars with an aspect ratio greater than 0.6 after the room-type mining, and uses the cemented filling material to replace the remaining coal pillars for support. Under the premise of ensuring safety, the method recovers coal resources and reduces the recovery cost. In addition, replacing the coal pillar with the cemented filling material for support can effectively support the overburden strata, prevent the rise of water flowing fractures and large-scale leakage of surface water, and reduce the impact of room-type coal pillar recovery on surface water and surrounding ecological environment. Moreover, replacing the room-type coal pillar with the cemented filling material for support also reduces the risk of fire and spontaneous combustion in the goaf. The method is convenient, reliable, and applicable, and thus has wide application prospects.

Figure 1:
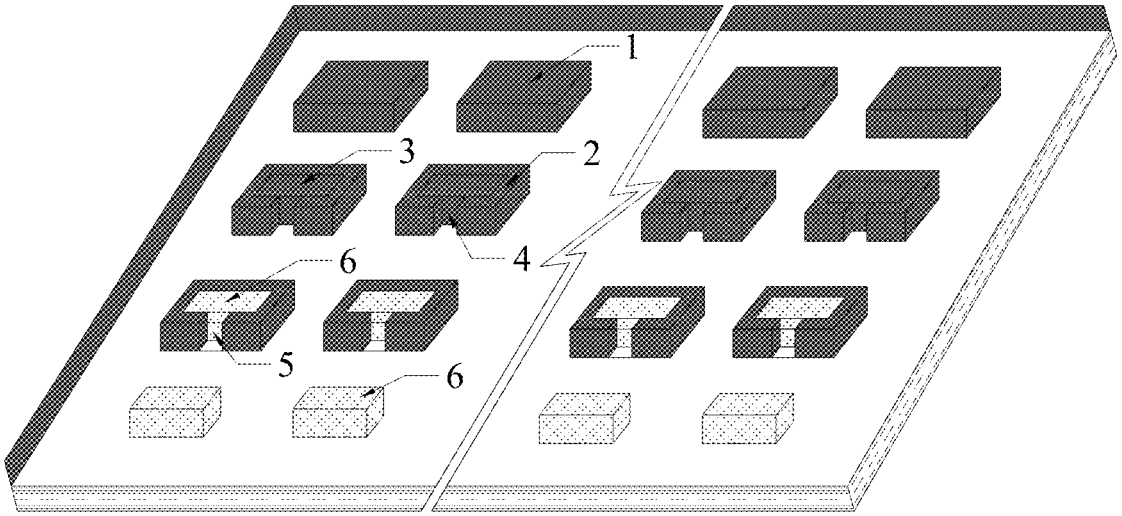
FIG. 1 is a plan view showing the layout of a coal mining face of the present invention.

In the drawings: 1 room-type coal pillar; 2 reserved coal pillar; 3 pre-mined coal pillar; 4 reserved coal pillar gap; 5 blocking wall; 6 cemented filling material; 7 continuous miner; 8 forklift; 9 belt conveyor.

DESCRIPTION OF THE EMBODIMENTS

The present invention discloses an internally injected replacement support room-type coal pillar recovery method. During the recovery of room-type coal pillars, the room-type coal pillars with an aspect ratio greater than 0.6 are divided into two parts: reserved coal pillars and pre-mined coal pillars. After the mining of the pre-mined coal pillars, a cemented filling material is injected into a goaf surrounded by the reserved coal pillars, and then is stabilized to replace the coal pillars for support, and the reserved coal pillars are then recovered. A mechanical model of the reserved coal pillars in the support overburden stage is established based on the Winkler beam theory, to obtain the displacement and stress conditions of a roof of the reserved coal pillar in the support stage. The theoretical reserve-width of the reserved coal pillars is obtained according to the first strength theory of the roof and the criterion of ultimate strength of the reserved coal pillars. The method can not only efficiently recover valuable coal resources and reduce waste of coal resources, but also effectively support the overburden and prevent a series of mine safety problems.

The present invention is further described below with reference to the accompanying drawings and embodiments.

An internally injected replacement support room-type coal pillar recovery method of the present invention: FIG. 1 is a plan view showing the layout of a coal mining face. In the process of recovering the room-type coal pillars with an aspect ratio greater than 0.6, the room-type coal pillars (1) are divided into reserved coal pillars (2) and pre-mined coal pillars (3) according to a calculation result of a mechanical model of the reserved coal pillars (2) in the support overburden stage, a reserved coal pillar gap (4) is opened, a continuous miner (7) is used to stope the pre-mined coal pillars (3), and the mined coal is transported onto a belt conveyor by means of a forklift (8) and transported out of a mining area by means of the belt conveyor (9). After the coal pillars (3) are stoped out, a blocking wall (5) is piled up to block the reserved coal pillar gap (4), and the cemented filling material (6) is pumped, by a filling pump through a pumping port reserved on the blocking wall (5), to the goaf of the large-scale room-type coal pillar for filling. The filling is carried out in three times to guarantee the stability of the blocking wall, and ensure the full filling of the cemented filling material (6). The reserved coal pillars (2) are recovered after the cemented filling material (6) is solidified and stabilized.

Figure 2:
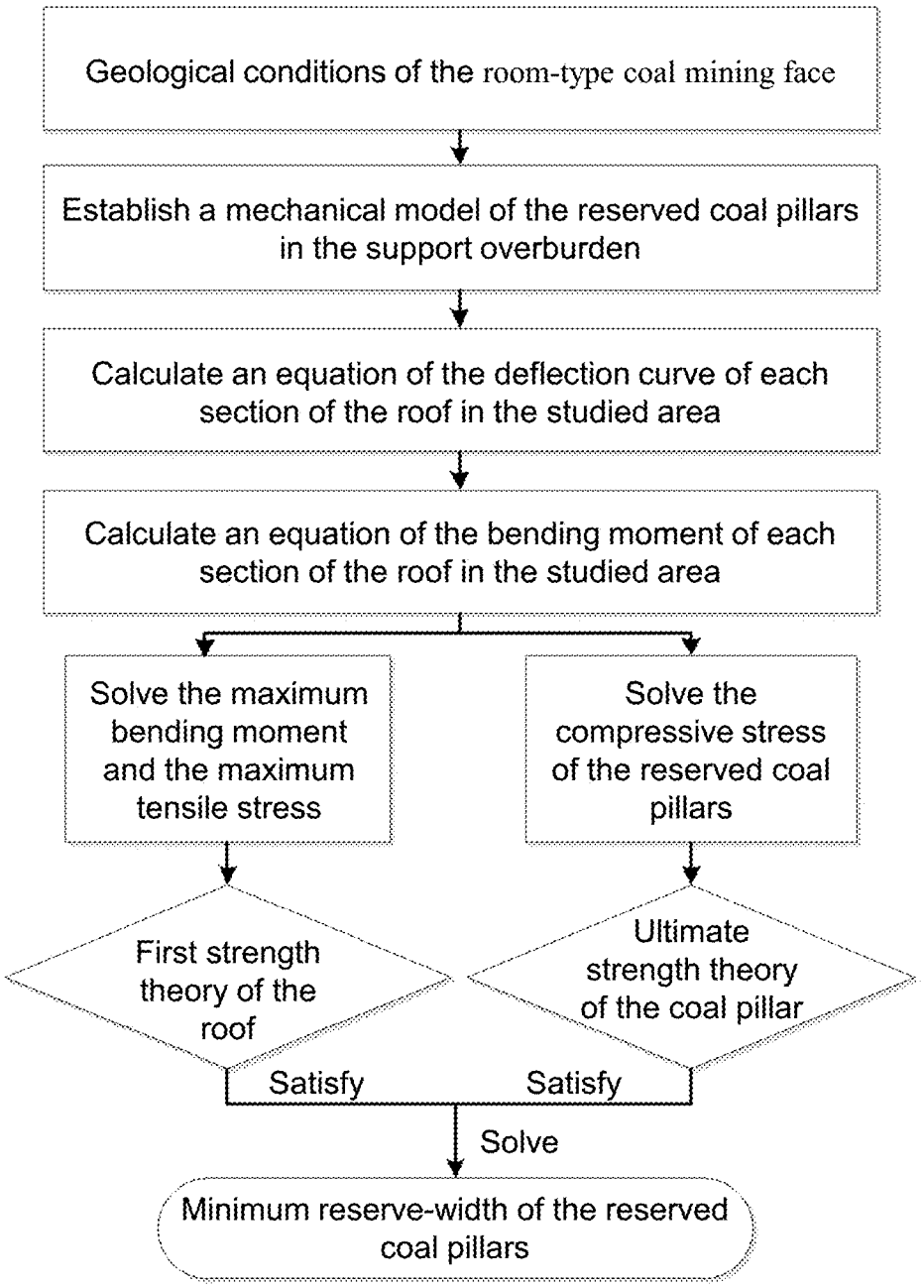
FIG. 2 is a flowchart for calculating the width of a reserved coal pillar of the present invention.
Figure 3:
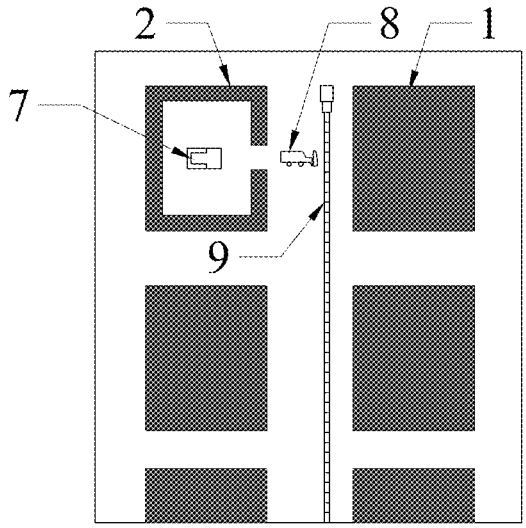
FIG. 3 is a plan view showing the recovery state of an internally injected replacement room-type coal pillar of the present invention.
Figure 4:
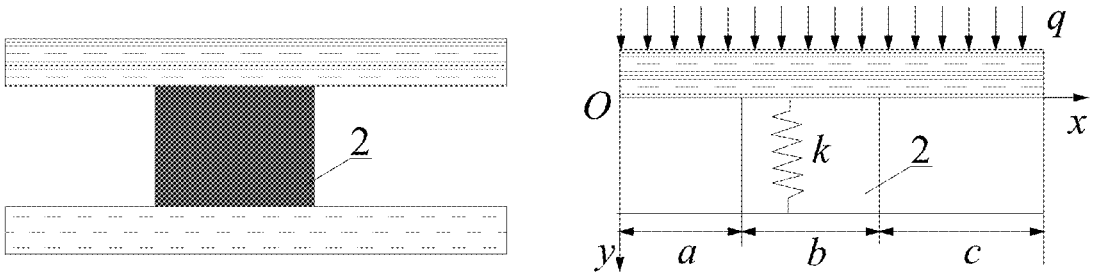
FIG. 4 is a mechanical model of the reserved coal pillar in the support overburden stage of the present invention; (a) of FIG. 4 is a schematic diagram for support structure of the reserved coal pillars, and (b) of FIG. 4 is a simplified mechanical model.

As shown in FIG. 2, the width of the reserved coal pillar (2) is calculated by a process as follows:

a. FIG. 3 is a plan view showing the recovery state of an internally injected replacement room-type coal pillar. A half-plane of the room-type coal pillar (1) is intercepted for analysis. The overburden stratum acting force on the roof is set to be a uniform load q, a foundation coefficient of the reserved coal pillar (2) to be k, the spacing of the adjacent room-type coal pillars (1) to be c, the width of the reserved coal pillar to be b, the width of the pre-mined coal pillar to be a, and then the total width of the room-type coal pillar to be 2(a+b), according to a mechanical model of the reserved coal pillar in the support overburden stage as shown in (a) and (b) of FIG. 4, wherein a differential equation of the deflection curve of each section of the roof in the analyzed area is:

$$\begin{cases} EI\dfrac{d^4\omega_1(x)}{dx^4} = q & x \in [0, a] \\ EI\dfrac{d^4\omega_2(x)}{dx^4} = q - k\omega_2(x) & x \in [a, a+b] \\ EI\dfrac{d^4\omega_3(x)}{dx^4} = q & x \in [a+b, a+b+c] \end{cases} \quad \text{(i)}$$

in the formula, EI is the flexural rigidity, in N/m;

x is the distance between any point on the foundation surface and the coordinate origin of the half-plane, in m; and $\omega_1(x)$, $\omega_2(x)$, and $\omega_3(x)$ are the deflections of x at sections [0, a], [a, a+b], [a+b, a+b+c] of the roof, respectively, in m.

b. Formula (i) is solved, and let $$\alpha = \sqrt[4]{\frac{k}{4EI}},$$

to obtain an equation of the deflection curve of the roof:

$$\begin{cases} \omega_1(x) = \dfrac{q}{24EI}x^4 + d_1x^3 + d_2x^2 + d_3x + d_4 \\ \omega_2(x) = \dfrac{q}{k} + d_5e^{-\alpha x}\cos(\alpha x) + d_6e^{-\alpha x}\sin(\alpha x) + \\ d_7e^{\alpha x}\cos(\alpha x) + d_8e^{\alpha x}\sin(\alpha x) \\ \omega_3(x) = \dfrac{q}{24EI}x^4 + d_9x^3 + d_{10}x^2 + d_{11}x + d_{12} \end{cases} \quad \text{(ii)}$$

in the formula, $d_1$, $d_2$, $d_3$, $d_4$, . . . and $d_{12}$ are constant coefficients; and parameters $d_1$-$d_{12}$ are obtained according to a model continuity condition and a symmetry boundary condition.

c. An equation of bending moment of the roof is solved:

$$\begin{cases} M_1(x) = -EI\dfrac{d^2\omega_1}{dx_2} \\ M_2(x) = -EI\dfrac{d^2\omega_2}{dx_2} \\ M_3(x) = -EI\dfrac{d^2\omega_3}{dx_2} \end{cases} \quad \text{(iii)}$$

in the formula, $M_1(x)$, $M_2(x)$, and $M_3(x)$ are the bending moments of x at sections [0, a], [a, a+b], and [a+b, a+b+c] of the roof, respectively, in m.

The width b of the reserved coal pillar (2) needs to simultaneously satisfy the first strength theory of the roof and the ultimate strength theory of the coal pillar, namely, simultaneously satisfying that the width b of the reserved coal pillar (2) is greater than or equal to the minimum reserve-width $b_1$ under the conditions of the first strength theory of the roof and the minimum reserve-width $b_2$ under the conditions of the ultimate strength theory of the coal pillar, specifically as shown in the following steps d and e.

d. The roof is simplified to a simply supported beam with an overburden uniform load q and a support load with the width $b_1$ at the bottom, wherein it is found through analysis that the maximum bending moment $M_{max}$ on the roof occurs in one side of the beam span that deviates from the bottom support load and is spaced apart from the model origin by $x_m = a + b_1 + 3EI \cdot d_9/q$, and a value thereof is obtained by $M_3(x_m)$ in the formula (iii), and the maximum tensile stress of the roof is obtained according to the rectangular beam theory:

$$\sigma_{max} = \frac{6M_{max}}{h^2} \quad \text{(iv)}$$

in the formula, h is the roof height, in m;

the following formula shall be satisfied according to the first strength theory of the roof, so that the roof is not broken:

$$\sigma_{max} \leq [\sigma_t] \quad \text{(v)}$$

in the formula, $[\sigma_t]$ is the allowable tensile stress of the roof, in MPa;

since the spacing c between the adjacent room-type coal pillars (1) and the width 2(a+b) of the room-type coal pillar are known, the minimum reserve-width $b_1$ of the reserved coal pillar (2) under the conditions of the first strength theory of the roof is obtained according to the judgment condition of the formula (iv).

e. The minimum reserve-width $b_2$ of the reserved coal pillar (2) under the conditions of the ultimate strength theory of the coal pillar satisfies its own non-destruction at the same time, and the following formula shall be satisfied according to the ultimate strength theory:

$$\sigma F \leq \sigma_P \quad \text{(vi)}$$

in the formula, σ is the force acting on the coal pillar, $\sigma = k\int_a^{a+b} \omega_2(x)dx$, in m;

F is a safety coefficient, which may be 2; and $\sigma_P$ is the ultimate strength of the reserved coal pillar, in MPa;

the minimum reserve-width of the reserved coal pillar (2) under the conditions of the ultimate strength theory is calculated to be $b_2$ according to the formula (vi).

Finally, the minimum reserve-width of the reserved coal pillar (2) is calculated to be $b = \max\{b_1, b_2\}$.

Embodiments

Figure 5:
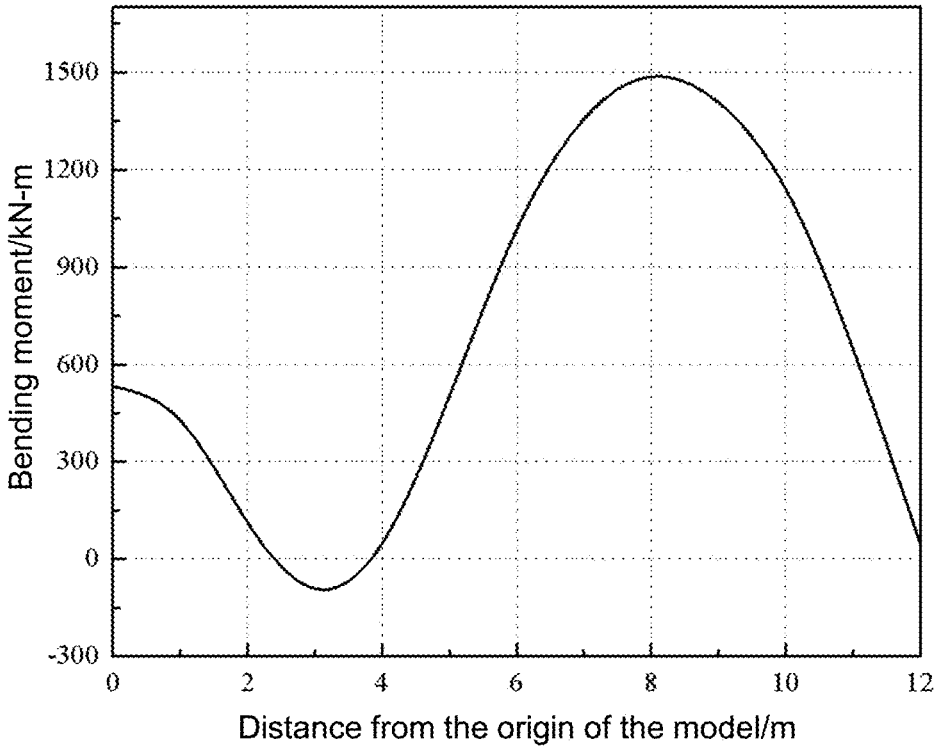
FIG. 5 is a distribution diagram of the bending moment of a roof of the present invention.
Figure 6:
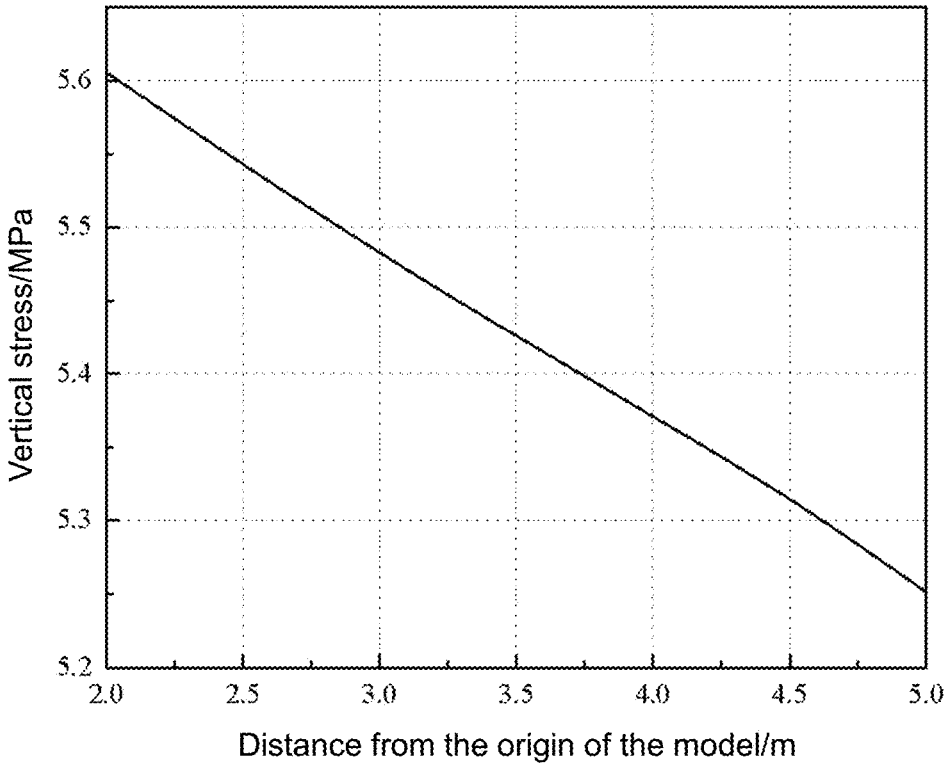
FIG. 6 is a graph showing the compression of the coal pillar of the present invention.

According to the foregoing solving methods, taking the geological conditions of a mine in the Northwest China as an example, the roof thickness of the mine is 2 m, the mining height is 4 m, the length of the coal pillar is about 10 m, the length of the coal room is about 7 m, the elastic modulus of the roof is 0.9 GPa, and the coal foundation coefficient is $2\times10^6$ N/m$^3$, the allowable tensile stress of the roof is 2.8 MPa, the ultimate strength of the reserved coal pillar is 49.3 MPa, and the uniform load q is 2 MPa. According to the formula (v), the bending moment distribution of the roof is as shown in FIG. 5 when the width of the reserved coal pillar is 3 m. In this case, the maximum tensile stress of the roof is 2.2 MPa, and the roof is not broken, and the graph showing the compression of the coal pillar is drawn, as shown in FIG. 6. It can be seen from the formula (vi) that the resultant force acting on the coal pillar is 21.7 MPa, and the current reserve-width of the coal pillar (2) satisfies the buckling ultimate strength theory of the coal pillar, so that the coal pillar (2) is not destroyed.

The contents above are only preferred embodiments of the present invention, and it should be noted that a person of ordinary skill in the art can make several modifications and improvements, without departing from the principle of the present invention. These improvements and modifications should also be construed within the protection scope of the present invention.

What is claimed is:

1. An internally injected replacement support room mining coal pillar recovery method, comprising the following steps:

1) dividing a room mining coal pillar into a peripheral reserved coal pillar and an internal pre-mined coal pillar, a reserved coal pillar gap being formed on one side of the reserved coal pillar;
2) stoping the internal pre-mined coal pillar by means of the reserved coal pillar gap;
3) blocking the reserved coal pillar gap after the pre-mined coal pillar is mined, and injecting a cemented filling material into a goaf surrounded by the reserved coal pillar for filling; and
4) replacing the pre-mined coal pillar for support after the cemented filling material is stabilized, and then recovering the reserved coal pillar, wherein a width of the reserved coal pillar is calculated by a process below:

a. intercepting a half-plane of the room mining coal pillar for analysis, and setting an overburden stratum acting force on a roof of a mine to be a uniform load q, a foundation coefficient of the reserved coal pillar to be k, a spacing of the adjacent room mining coal pillars to be c, the width of the reserved coal pillar to be b, a width of the pre-mined coal pillar to be a, and then a total width of the room mining coal pillars to be 2(a+b), wherein a differential equation of a deflection curve of each section of the roof in an analyzed area is:

$$\begin{cases} EI\dfrac{d^4\omega_1(x)}{dx^4} = q & x \in [0, a] \\ EI\dfrac{d^4\omega_2(x)}{dx^4} = q - k\omega_2(x) & x \in [a, a+b] \\ EI\dfrac{d^4\omega_3(x)}{dx^4} = q & x \in [a+b, a+b+c] \end{cases} \quad \text{formula (i)}$$

in the formula (i), EI is a flexural rigidity, in N/m;

x is a distance between any point on a foundation surface and a coordinate origin of the half-plane, in m; and $\omega_1(x)$, $\omega_2(x)$, $\omega_3(x)$ are deflections of x at sections [0, a], [a, a+b], and [a+b, a+b+c] of the roof, respectively, in m;

b. solving the formula (i), and letting $$\alpha = \sqrt[4]{\frac{k}{4EI}},$$

to obtain an equation of the deflection curve of the roof:

$$\begin{cases} \omega_1(x) = \dfrac{q}{24EI}x^4 + d_1x^3 + d_2x^2 + d_3x + d_4 \\ \omega_2(x) = \dfrac{q}{k} + d_5e^{-\alpha x}\cos(\alpha x) + d_6e^{-\alpha x}\sin(\alpha x) + \\ d_7e^{\alpha x}\cos(\alpha x) + d_8e^{\alpha x}\sin(\alpha x) \\ \omega_3(x) = \dfrac{q}{24EI}x^4 + d_9x^3 + d_{10}x^2 + d_{11}x + d_{12} \end{cases} \quad \text{formula (ii)}$$

in the formula (ii), $d_1$, $d_2$, $d_3$, $d_4$, . . . and $d_{12}$ are constant coefficients; and obtaining parameters $d_1$-$d_{12}$ according to a model continuity condition and a symmetry boundary condition;

c. solving to obtain an equation of bending moment of the roof:

$$\begin{cases} M_1(x) = -EI\dfrac{d^2\omega_1}{dx_2} \\ M_2(x) = -EI\dfrac{d^2\omega_2}{dx_2} \\ M_3(x) = -EI\dfrac{d^2\omega_3}{dx_2} \end{cases} \quad \text{formula (iii)}$$

in the formula (iii), $M_1(x)$, $M_2(x)$, and $M_3(x)$ are the bending moments of x at sections [0, a], [a, a+b], and [a+b, a+b+c] of the roof, respectively, in m, wherein the width b of the reserved coal pillar needs to simultaneously satisfy a first strength theory of the roof and an ultimate strength theory of the coal pillar, namely, simultaneously satisfying that the width b of the reserved coal pillar is greater than or equal to a minimum reserve-width $b_1$ under conditions of the first strength theory of the roof and a minimum reserve-width $b_2$ under conditions of the ultimate strength theory of the coal pillar, specifically as shown in the following steps d and e:

d. simplifying the roof to a simply supported beam with an overburden uniform load q and a support load with the width $b_1$ at the bottom, wherein it is found through analysis that a maximum bending moment $M_{max}$ on the roof occurs in one side of a beam span that deviates from a bottom support load and is spaced apart from a model origin by $x_m=a+b_1+3EI\cdot d_9/q$, and a value thereof is obtained by $M_3(x_m)$ in the formula (iii), and then a maximum tensile stress of the roof is obtained according to a rectangular beam theory:

$$\sigma_{max} = \frac{6M_{max}}{h^2} \quad \text{formula (iv)}$$

in the formula (iv), h is a roof height, in m;

the following formula shall be satisfied according to the first strength theory of the roof, so that the roof is not broken:

$$\sigma_{max} \leq [\sigma_t] \quad \text{formula (v)}$$

in the formula (v), $[\sigma_t]$ is an allowable tensile stress of the roof, in MPa; and since the spacing c between the adjacent room mining coal pillars and the width 2(a+b) of the room mining coal pillar are known, the minimum reserve-width $b_1$ of the reserved coal pillar under the conditions of the first strength theory of the roof is obtained according to a judgment condition of the formula (iv);

e. making the minimum reserve-width $b_2$ of the reserved coal pillar under the conditions of the ultimate strength theory of the coal pillar satisfy its own non-destruction at the same time, and satisfying according to the ultimate strength theory:

$$\sigma F \leq \sigma_p \quad \text{formula (vi)}$$

in the formula (vi), σ is a force acting on the coal pillar, $\sigma=k\int_a^{a+b} \omega_2(x)dx$, in m;

F is a safety coefficient, which is 2; and $\sigma_p$ is an ultimate strength of the reserved coal pillar, in MPa;

calculating the minimum reserve-width of the reserved coal pillar under the conditions of the ultimate strength theory of the coal pillar to be $b_2$ according to the formula (vi); and f. finally calculating the minimum reserve-width of the reserved coal pillar to be $b=\max\{b_1, b_2\}$.

2. The internally injected replacement support room mining coal pillar recovery method according to claim 1, wherein the room mining coal pillar has an aspect ratio greater than 0.6.

3. The internally injected replacement support room mining coal pillar recovery method according to claim 1, wherein in step 1) displacement and stress conditions of the roof when the reserved coal pillar is in a support stage are obtained according to a calculation result of a mechanical model of the reserved coal pillar in a support overburden stage; and a theoretical reserve-width of the reserved coal pillar is obtained according to the first strength theory of the roof and a criterion of ultimate strength of the reserved coal pillar, so that the room mining coal pillar is divided into the reserved coal pillar and the pre-mined coal pillar.

4. The internally injected replacement support room mining coal pillar recovery method according to claim 1, wherein in step 2) a continuous miner is used to stope the pre-mined coal pillar, and a mined coal is transported onto a belt conveyor by means of a forklift and transported out of a mining area by means of the belt conveyor.

5. The internally injected replacement support room mining coal pillar recovery method according to claim 1, wherein in step 3) a blocking wall is piled up to block the reserved coal pillar gap, and the cemented filling material is pumped, by a filling pump through a pumping port reserved on the blocking wall, to the goaf of the room mining coal pillar for filling.

* * * * *